United States Patent [19]

Joos

[11] Patent Number: 4,773,137

[45] Date of Patent: Sep. 27, 1988

[54] METHOD OF WINDING AND CHANGING WARP BEAMS OF WEAVING LOOMS

[75] Inventor: Waelkens Joos, Ieper, Belgium

[73] Assignee: Picanol N.V., Belgium

[21] Appl. No.: 55,158

[22] Filed: May 28, 1987

[30] Foreign Application Priority Data

May 29, 1986 [NL] Netherlands ..... 8601380

[51] Int. Cl.[4] ..... B65H 67/00

[52] U.S. Cl. ..... 28/201; 28/209

[58] Field of Search ..... 139/29, 35, 1 R; 28/172, 190, 193, 201, 209, 210

[56] References Cited

U.S. PATENT DOCUMENTS 1,592,450 7/1926 Eggart ..... 28/190
2,025,890 12/1935 Payne .

FOREIGN PATENT DOCUMENTS 86546 9/1920 Switzerland .
834193 5/1960 United Kingdom .

*Primary Examiner*—Henry S. Jaudon
*Attorney, Agent, or Firm*—Bacon & Thomas

[57] ABSTRACT

A process for coiling warp beams of looms involves winding new warp threads on warp beams with free ends of predetermined length double wound on the beams at the beginning of the winding process. A warp beam with a securing system for warp threads arranged to leave free ends of the warp threads is described. For changing a warp beam, the free ends of the double coiled warp threads are released from the warp beam before the beam is completely unwound and the free ends are tied to the leading ends of warp threads on the next succeeding warp beam without stopping the weaving process.

3 Claims, 3 Drawing Sheets

Fig.5
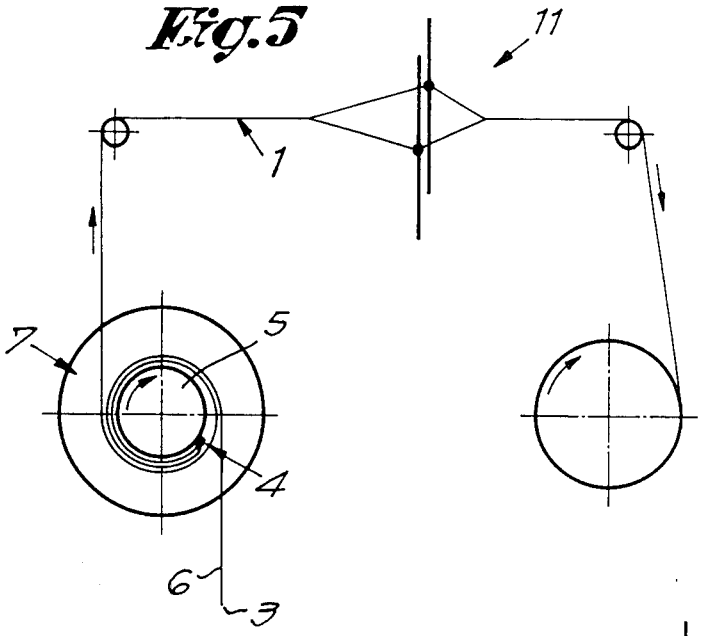
Fig.6
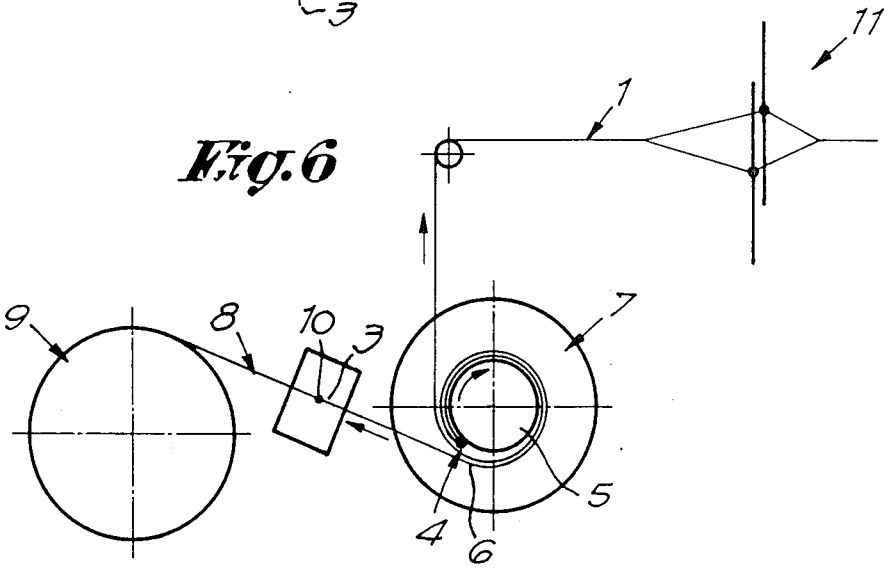
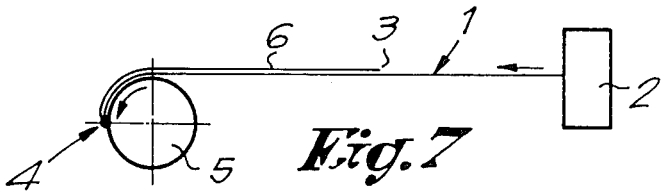
Fig.7

Fig. 8
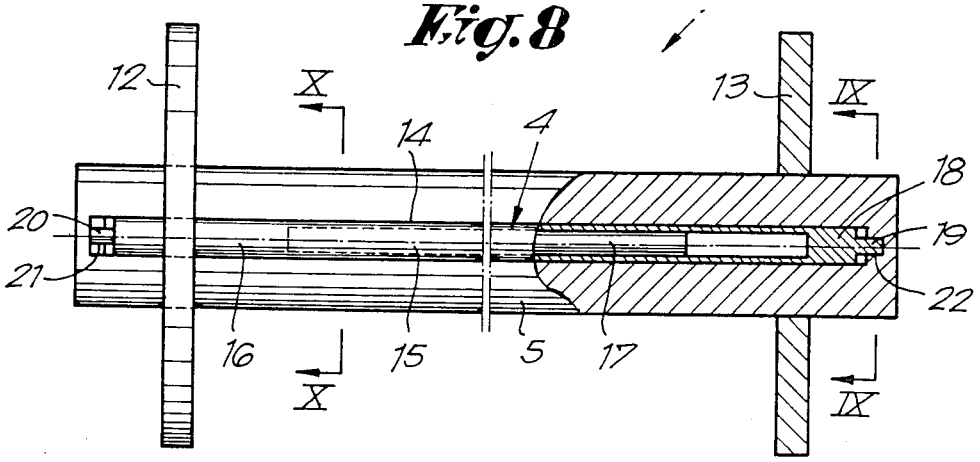
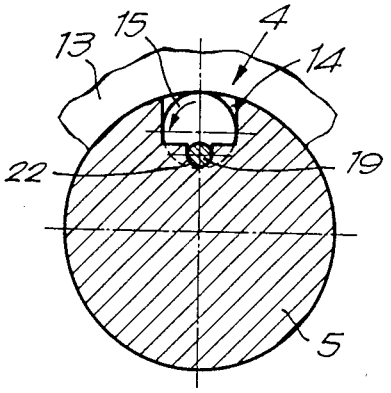
Fig. 9
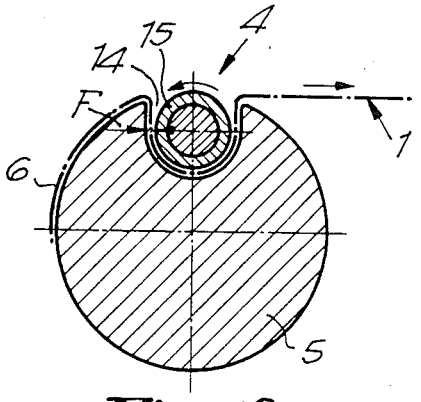
Fig. 10
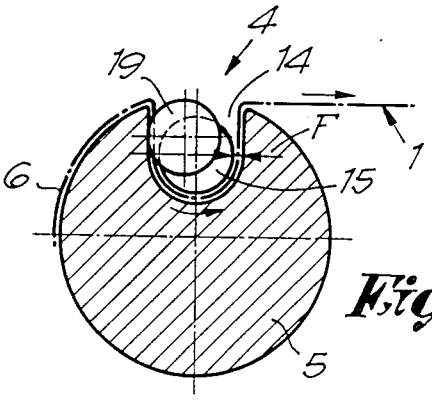
Fig. 11

METHOD OF WINDING AND CHANGING WARP BEAMS OF WEAVING LOOMS

BACKGROUND OF THE INVENTION

The present invention concerns a method for winding a warp beam of weaving looms. Moreover, this invention also concerns a method for changing a warp beam wound in accordance with the invention.

It is well known that the changing of warp beams requires considerable time because, when the warp beam to be replaced is completely unwound, all the remaining loose ends of the old warp threads must be tied up to the new warp threads of the succeeding wound warp beam. Quite obviously, such a loss of time has a strong negative influence on the output of the weaving looms.

According to a first known method, a solution has been devised which keeps this time loss relatively limited by using warp beams having a diameter as large as possible; this solution resulted in the advantage that less warp beam changes were required. Taking into account, however, the very large weaving speeds of present day looms, this time saving can contribute on a limited scale only to the improvement of the weaving loom output.

According to a second known method that is described in the Belgian patent application No. PV 2/60785, assigned to the assignee of this application, and published Mar. 6, 1986, the stopped time of a weaving loom is reduced by removing the part with the warp beam change must occur and by replacing it by a similar part that is equipped with a new warp beam to be woven, whereby the tying up of the new warp threads to the warp thread ends of a fabric carried out previously in a separate room prior to this replacement. This method offers, however, the disadvantage that the aforesaid part of the weaving loom must be disassembled and specific facilities must be provided for removing these parts.

The present invention is thus aimed at limiting the aforesaid time loss or even to eliminate it completely.

SUMMARY OF THE INVENTION

The invention contemplates the possibility of beginning the tying up of the new warp threads before the weaving loom is stopped and also to terminate the tying up of the new warp threads before the weaving loom should be stopped or, in other words, before the warp beam to be replaced is completely coiled off or unwound. More specifically, this result is achieved according to the invention by using a special method for coiling warp beams and then changing the warp beams utilizing the specially coiled warp beam.

This method for changing a warp beam is characterized according to the present invention by the fact that a warp beam is used where, at the beginning of coiling, the warp threads are coiled up with a double fold extending over a specific length of the threads.

The present invention also is concerned with a warp beam that is particularly adapted for practicing aforesaid method.

BRIEF DESCRIPTION OF THE DRAWINGS

For a better understanding of the invention, a few preferred embodiments are described in the drawings, wherein:

FIGS. 5–6 schematically illustrate a warp beam changeover carried out according to the invention;

FIG. 7 is an illustration of an alternative method for winding up the warp beam;

FIG. 8 is a partial cross-section through a warp beam constructed according to the invention;

FIG. 9 is a cross-section view along line IX—IX of FIG. 8;

FIG. 10 is a cross-section view along the line X—X of FIG. 8; and

FIG. 11 illustrates an alernative embodiment of a warp beam viewed in the same direction as the view of FIG. 9.

DESCRIPTION OF THE PREFERRED EMBODIMENTS OF THE INVENTION

Figure 1:
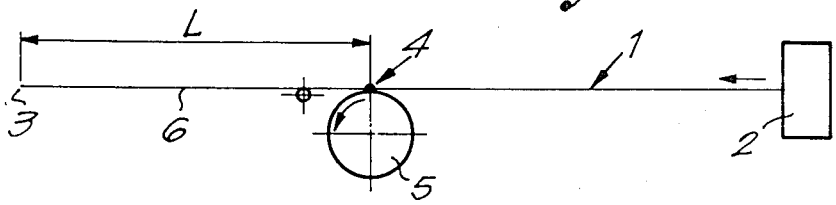
FIGS. 1–4 schematically illustrate the various steps of the inventive method for winding up a warp beam with warp threads.

According to FIGS. 1–4, the method of the present invention essentially involves fastening the warp threads 1, to be coiled up on the warp beam 5 and coming from a thread supply 2 at some distance, for instance, distance L from their ends 3 by means of securing means 4 (described later) on the warp beam shaft 5. Afterwards, the free thread lengths 6 obtained this way and the warp theads coming from the aforesaid thread supply 2, are commonly or double wound on the warp beam shaft 5 (FIGS. 2–4).

Figure 2:
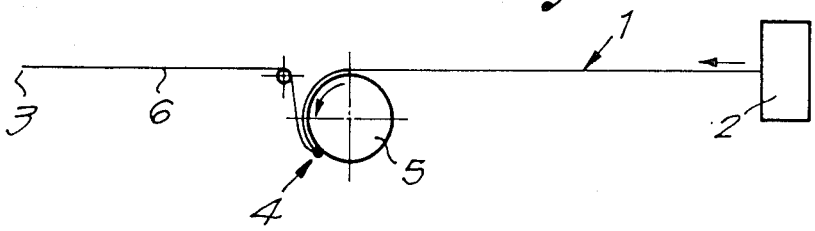
Figure 3:
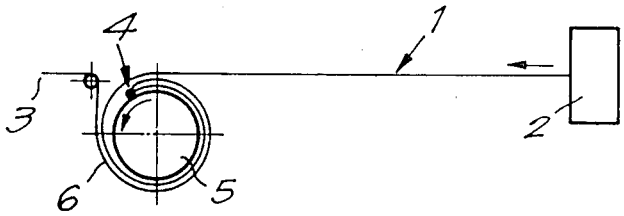
Figure 4:
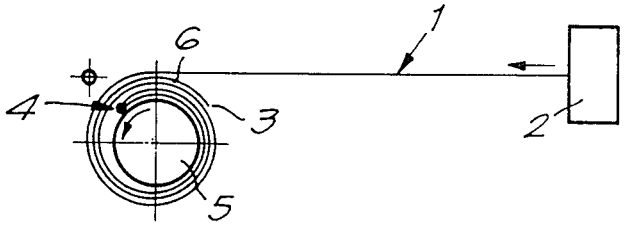

As respectively illustrated in FIGS. 2–4, the free thread lengths 6 are completely coiled up between the warp threads 1 that are received from the thread supply 2.

The change of a warp beam 7 that has been wound according to the aforesaid method illustrated in FIGS. 1–4, will now be carried out according to the invention, mainly as schematically illustrated in FIGS. 5 and 6. As shown in FIG. 5, the ends 3 of the warp threads 1 are made free during the uncoiling of the warp beam 7 before the warp beam 7 is completely uncoiled. When the free thread lengths 6 are displaced far enough away from the warp beam 7, the aforesaid ends 3 can be tied up to the warp theads 8 of the new warp beam 9, while the warp threads 1 are still being unwound from the warp beam 7. This operation is illustrated in FIG. 6. The ties 10 between the different warp threads 1 and 8 may be carried out according to any known method.

When the warp beam 7 to be replaced is completely unwound, the securing means 4 are loosened or removed and the empty warp beam 7 can be removed. The weaving loom 11 can then take the warp theads 8 from the new warp beam 9. Although not necessary, the length L of the free thread lengths 6 preferably will be selected in such a way that the uncoiling operation of these thread lengths allows sufficient time for tying up all the new warp threads 8. In this way, continuous weaving is made possible, and no time loss occurs as the weaving loom is not required to be stopped.

It is possible, however, that thread breaks taking place during the preparation of the warp beams result in some of the warp threads being shorter than the other threads by one or several turns on the warp beam. If the distance of the lengths of thread where the threads are double folded is chosen large enough, however, it is possible to achieve the tying up operation before the shortest thread is uncoiled. Quite obviously, it is necessary that the tying up operation of the thread lengths be conducted in such a way that, at the beginning of the following warp beam, all threads have the same length. To achieve this, it is possible to replace, for instance, the warp beam 7 as soon as the shortest warp thread is uncoiled.

Quite obviously, the aforesaid method for coiling up a warp beam can be carried out according to several alternative solutions. For instance, and as illustrated in FIG. 1, the free thread lengths 6 and the warp threads 1 coming from the thread supply 2 may be coiled up in a taut condition. This condition is, however, not necessary. It is indeed quite possible, as shown in FIG. 7, that the warp threads 1 be double folded and that they be fastened to the warp beam shaft 5 at their folded edge by means of the aforesaid securing means 4.

In order to carry out the aforesaid method for winding the warp beam, a warp beam 7 as illustrated in FIG. 8 preferably shall be used. This warp beam 7 is mainly composed of a warp beam shaft 5 and, for instance, two beam sides 12 and 13 between which the warp threads are wound. According to the present invention, this warp beam 7 is equipped with securing means 4, used for fastening the warp threads 1 to the warp beam shaft 5 according to the aforesaid method.

The securing means are mainly composed, according to the preferred embodiment, of a groove 14 in the warp beam rod 5 and of a clamping element, for instance, a shaft 15 that can cooperate with groove 14 in such a way that the warp threads 1 can be clamped to the shaft when they are guided underneath the clamping element 15. Groove 14 and the clamping element of the shaft 15 will be preferably located beneath the beam sides 12 and 13 in such a way that the clamping element of the shaft 15 is secured in notch 14 by the beam sides 12 and 13. In this case, the shaft 15 may have a telescopic design as shown in FIG. 8 and shall be composed, for instance, of three parts, respectively, 16 to 18. In a retracted position, the shaft 15 can be placed between the sides 12 and 13 and then the shaft can be extended beneath the beam sides for normal use.

The various parts 16, 17 and 18 can be secured to each other for instance by means of known elements that are not illustrated in the figures. According to an alternative solution, the telescopic shaft 15 can also be equipped with internal resilient means, whereby the shaft is automatically extended underneath the beam sides 12 and 13 after being placed in the notch.

The clamping element or the shaft 15 can also be flexible instead of having a telescopic design.

The clamping element or the shaft 15 is equipped, as shown in FIGS. 8–11, preferably with eccentric ends 19 and 20, whereby under the influence of friction force applied by the tensioned warp threads 1 to the clamping element, a good clamping effect can be achieved.

As shown in FIGS. 8 and 9, the eccentric ends 19 and 20 have a diameter smaller than the diameter of the shaft 15. The ends 19 and 20 are sunk in separate notches 21 and 22 at the ends and in the bottom of notch 14. The force applied by the friction of the tensioned warp thread 1 to the shaft 15 results in a rotation moment in the shaft about the eccentric, whereby a compression force F is applied between a wall of groove 14 and the shaft 15 is illustrated in FIG. 10, thereby clamping the warp thread.

FIG. 11 illustrates still another alternative embodiment for eccentric ends 19 and 20 of the shaft whereby, according to this embodiment, the ends have a diameter equal to the diameter of the shaft 15. The separate grooves 21 and 22 are unnecessary in this case. In the same way as illustrated in FIG. 10, a pulling force in the warp threads 1 also results into a compression force F of the shaft 15 on a wall of groove 14, whereby the warp threads 1 are strongly secured.

Quite obviously, the securing means 4 must not necessarily be composed of clamping elements and may be of any other suitable kind.

Known detectors or gauges can also be used in order to detect an empty warp beam or a practically empty warp beam.

The present invention is by no means limited to the embodiment of the method described by way of example and illustrated by the figures. This method as well as the warp beam used to carry out the method, could be modified by a person skilled in the art in respect of details within the scope of the invention which is limited only by the claims below.

What is claimed is:

1. A method of changing warp beams of a weaving loom comprising:

supplying warp threads to be wound on a warp beam from a source and securing the threads to a warp beam at a predetermined distance from their free ends so as to leave free lengths of warp threads extending from the warp beam;

wrapping the warp threads from the source and the free ends of the warp threads around the warp beam in double wound fashion so the thread free ends extend back toward the source relative to the coiling direction;

continuing the winding of the threads from the thread source until the beam is fully wound;

carrying out a weaving process including unwinding warp threads from the warp beam until the double wound free ends of the threads are released from the beam;

preparing a second warp beam to be used in the weaving process by winding warp threads thereon, said second beam having free ends of warp threads to be introduced into the loom, and locating the second beam sufficiently proximate the first beam so that the free ends of threads from both warp beams can be tied together;

tying together the free ends of the threads on both beams;

releasing the warp threads from the first beam and removing the first beam from the loom.

2. A method of changing warp beams as claimed in claim 1, wherein the free ends of warp threads on both first and second warp beams are tied together during the weaving operation and while the first beam is unwinding toward a fully unwound condition and wherein the first beam is removed from and the second beam is placed in service in the loom without interrupting the weaving operation.

3. A method of changing warp beams as claimed in claim 1 or 2, including winding said second warp beam along with succeeding warp beams with warp threads in the same manner as the first warp beam, and successively changing warp beams in the same manner as the changeover between the first and second warp beams.

* * * * *

UNITED STATES PATENT AND TRADEMARK OFFICE

CERTIFICATE OF CORRECTION

PATENT NO. : 4,773,137

DATED : September 27, 1988

INVENTOR(S) : Joos WAELKENS

It is certified that error appears in the above-identified patent and that said Letters Patent is hereby corrected as shown below:

ON THE TITLE PAGE:

The name of the inventor is Joos WAELKENS.

Item [19] "Joos" should read -- Waelkens --.

Signed and Sealed this

Fourteenth Day of February, 1989

*Attest:*

DONALD J. QUIGG

*Attesting Officer*

*Commissioner of Patents and Trademarks*